United States Patent [19]

Raasch

[11] Patent Number: 4,777,790

[45] Date of Patent: Oct. 18, 1988

[54] METHOD AND APPARATUS FOR STOPPING AND SUBSEQUENTLY RESTARTING AN OPEN END SPINNING MACHINE

[75] Inventor: Hans Raasch, Monchen Gladbach, Fed. Rep. of Germany

[73] Assignee: W. Schlafhorst & Co., Fed. Rep. of Germany; a part interest

[21] Appl. No.: 109,771

[22] Filed: Oct. 16, 1987

[30] Foreign Application Priority Data

Oct. 18, 1986 [DE] Fed. Rep. of Germany ..... 3635510

[51] Int. Cl.[4] ..... D01H 15/02; D01H 13/16

[52] U.S. Cl. ..... 57/263; 57/81; 57/261; 57/405

[58] Field of Search ..... 57/78, 80, 81, 261–264, 57/405

[56] References Cited

U.S. PATENT DOCUMENTS

| | | | |
|---|---|---|---|
| 4,472,933 | 9/1984 | Raasch et al. | 57/263 |
| 4,494,371 | 1/1985 | Morita et al. | 57/263 |
| 4,538,408 | 9/1985 | Baltsch et al. | 57/263 |
| 4,611,462 | 9/1986 | Pinner et al. | 57/263 |
| 4,628,684 | 12/1986 | Morita et al. | 57/263 |
| 4,644,742 | 2/1987 | Lovas et al. | 57/263 |
| 4,653,261 | 3/1987 | Schreiber et al. | 57/263 |
| 4,660,365 | 4/1987 | Raasch | 57/263 |
| 4,712,367 | 12/1987 | Lassmann | 57/263 |

FOREIGN PATENT DOCUMENTS

| | | |
|---|---|---|
| 2346124 | 3/1974 | Fed. Rep. of Germany . |
| 2313788 | 10/1974 | Fed. Rep. of Germany . |
| 2417758 | 11/1974 | Fed. Rep. of Germany . |
| 2458042 | 6/1976 | Fed. Rep. of Germany . |
| 2525069 | 12/1976 | Fed. Rep. of Germany . |
| 2629902 | 1/1977 | Fed. Rep. of Germany . |
| 2534863 | 2/1977 | Fed. Rep. of Germany . |
| 2643625 | 4/1977 | Fed. Rep. of Germany . |
| 2849061 | 5/1979 | Fed. Rep. of Germany . |
| 2802536 | 7/1979 | Fed. Rep. of Germany . |

*Primary Examiner*—John Petrakes

*Attorney, Agent, or Firm*—Shefte, Pinckney & Sawyer

[57] ABSTRACT

A method and apparatus for stopping and subsequently restarting an open end spinning machine wherein, upon an electrical power interruption exceeding a predetermined duration, the spinning rotor, sliver feed roller, yarn take-up roller, and yarn winding drum are deactuated, the yarn take-up roller and winding drum are braked to a standstill, and the length of withdrawn yarn during braking is measured and stored, and, upon restarting of the machine, the sliver feed roller is briefly operated to initially deliver a start-up sliver length to the rotor and yarn take-up roller and yarn winding drum are operated in reverse to feed back to the rotor a length of withdrawn yarn corresponding to the measured and stored yarn length in advance of reactuation of the spinning operation.

22 Claims, 1 Drawing Sheet

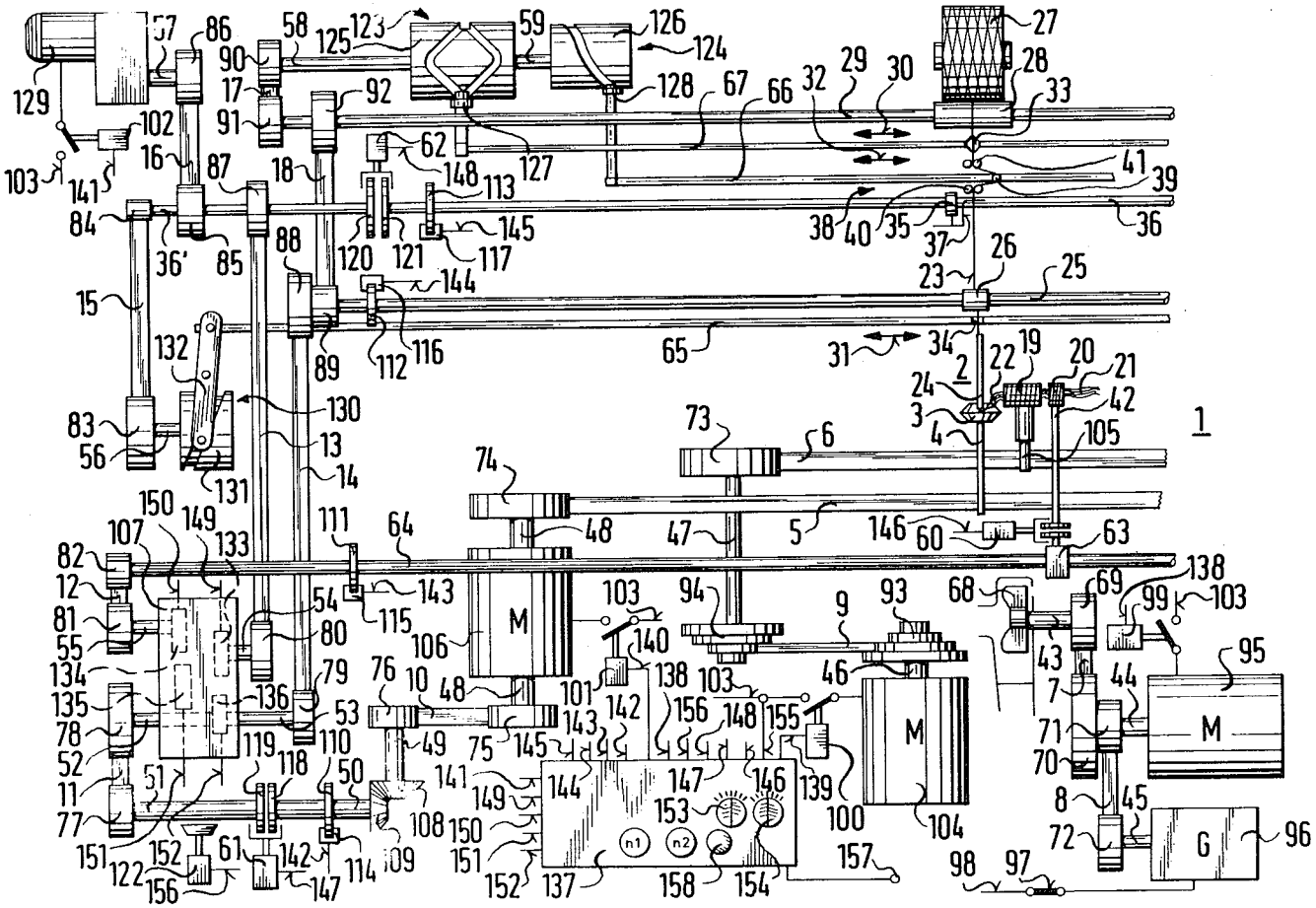

METHOD AND APPARATUS FOR STOPPING AND SUBSEQUENTLY RESTARTING AN OPEN END SPINNING MACHINE

BACKGROUND OF THE INVENTION

The present invention relates to open end spinning machines and methods wherein sliver in an opened form is fed into a rotating spinning rotor in which the fibers are collected and twisted to a desired yarn count with the yarn being progressively withdrawn from the rotor and wound onto a suitable bobbin or other yarn package. More particularly, the present invention relates to a novel method and apparatus for stopping and subsequently restarting the operative components of the open end spinning machine in a controlled manner upon an interruption in the power supply to the machine, whether the stoppage is intentional or unintentional. Further, the present invention is particularly adapted to prevent stoppages of the open end spinning machine unless such stoppages are unavoidable, such as for example an intentional deactuation of the machine, while avoiding machine stoppages in response to brief interruptions or fluctuations in the power supply to the machine.

SUMMARY OF THE INVENTION

Open end spinning machines of the type to which the present invention relates typically include a spinning rotor, means for rotating the spinning rotor, means for feeding sliver to the spinning rotor, means for opening the sliver intermediate the sliver feeding means and the rotor, means for withdrawing and winding yarn from the spinning rotor, and a power supply thereto. According to the method and apparatus of the present invention, the rotor rotating means, sliver feeding means, sliver opening means and yarn withdrawing and winding means are deactuated upon an interruption in the power supply and the yarn withdrawing and winding means is braked to a standstill after a delay following such deacutation determined in relation to the rate of yarn withdrawal from the rotor. A control arrangement at the same time determines and stores a value representing the length of the yarn withdrawn by the yarn withdrawing and winding means during the braking. When the machine is ready to be restarted, the control arrangement initially actuates the sliver opening means and then actuates the rotor rotating means. The control arrangement monitors an operating parameter of the rotor rotating means which is representative of the speed of the rotor following reactuation of the rotor rotating means. When the rotor attains a predetermined first speed, the control arrangement actuates the sliver feeding means to feed a predetermined start-up length of sliver to the rotor, after which the sliver feeding means is deactuated. When the rotor attains a predetermined second speed, the control arrangement actuates the yarn withdrawing and winding means in reverse direction to feed back to the rotor a length of withdrawn yarn corresponding to the stored value previously determined at the time of machine stoppage. Thereupon, the yarn withdrawing and winding means is reactuated in forward direction and the sliver feeding means is again actuated, thereby restarting the spinning operation. The second predetermined speed is determined as a function of the desired rotor operating speed while the first predetermined speed is determined as a function of the second speed.

According to the present invention, the rotor rotating means, sliver feeding means and yarn withdrawing and winding means are not deactuated under the present method and apparatus until the duration of the interruption exceeds a predetermined time period, preferably approximately two seconds. For this purpose, the control arrangement includes a generator operatively connected to the power supply for generating a control voltage for the controlling arrangement. The generator includes a flywheel of sufficient mass and normal operating velocity to sustain the control voltage for the predetermined time period following a power interruption to prevent deactuation of the operating components of the machine during the duration of the predetermined time period. Upon restarting of the machine, the generator is reactuated in advance of the rotor rotating means to establish the control voltage.

Preferably, the open end spinning machine includes suction means for producing a spinning vacuum within the rotor. The control arrangement is operative to deactuate the suction means upon a power interruption and to reactuate it in advance of the rotor rotating means when the machine is restarted.

The yarn withdrawing and winding means preferably includes a yarn take-up shaft for withdrawing yarn from the rotor, a yarn package for peripheral winding of yarn thereabout and a winding drum rotatable in peripheral driving contact with the package during yarn winding. According to the present method and apparatus, the control arrangement is adapted to regulate braking of the yarn take-up shaft and the winding drum in a controlled manner in relation to the rate of yarn withdrawal from the rotor and the peripheral contact pressure between the winding drum and the yarn package.

Further, the open end spinning machine includes a main drive motor with a first associated drive train for driving the rotor rotating means, the sliver feeding means and the yarn withdrawing and winding means during normal operation of the machine. An auxiliary drive motor with a second associated drive train is also provided for driving the sliver feeding means and for reverse driving of the yarn withdrawing and winding means during restarting of the machine following an interruption. A transmission arrangement is associated with the first and second drive trains for selectively coupling the sliver feeding means and the yarn withdrawing and winding means with one of the main and auxiliary drive motors, the control arrangement being operatively associated with the transmission arrangement for controlling coupling thereof with the sliver feeding means and the yarn withdrawing and winding means.

It is additionally preferred that the open end spinning machine include first traversable yarn guide means, auxiliary traversable yarn guide means, yarn tension monitoring means, and selectively traversable yarn storage means. The control arrangement is operative to deactuate each thereof upon a power interruption, with the first yarn guide means and the yarn storage means being braked simultaneously with the yarn withdrawing and winding means. The yarn tension monitoring means is of the type arranged for movement into and out of contact with the yarn, the control arrangement being operative for deactuating the yarn monitoring means only when out of contact with the yarn.

BRIEF DESCRIPTION OF THE DRAWING

The accompanying drawing is a schematic diagram illustrating the apparatus of the present invention as preferably embodied in an open end spinning machine for carrying out the present method.

DESCRIPTION OF THE PREFERRED EMBODIMENT

Referring now to the accompanying drawing, an open end spinning machine is schematically indicated generally at 1. As will be understood, the spinning machine 1 typically has a plurality of spinning stations, only one of which is depicted in the drawing at 2. A spinning rotor 3 is mounted at the spinning station 2 on a shaft 4 peripherally driven by a drive belt 5. A sliver opening roller 19 is mounted adjacent the spinning rotor 3 on a whorl 105 peripherally driven by a drive belt 6. A sliver feed roller 20 is rotatably mounted adjacent the opening roller 19 on a shaft 42 for continuously feeding a supply of sliver 21 to the opening roller 19 which, in turn, opens the individual fibers 22 of the sliver before transporting them into the rotor 3. The shaft 42 of the sliver feed roller 20 is connected by a selectively actuable coupling device 60, such as a clutch or the like, with a miter gear 63 mounted on a sliver feed shaft 64 for selective driving of the feed roller 20.

A yarn 23 is formed in essentially conventional manner within the rotor 3 and is continually withdrawn therefrom through a tube 24 by a yarn take-up roller 26 mounted on a rotatable shaft 25, from which the yarn 23 is fed to a cross-wound bobbin or similar yarn package 27. The bobbin 27 is rotatably driven for winding of the yarn 23 thereabout by a winding drum 28 mounted on a rotatable winding shaft 29 to be in peripheral driving contact with the outer periphery of the bobbin 27.

A yarn guide 33 is supported on a reciprocable slide rod 67 adjacent the winding drum 28 for traversing back and forth alongside the drum 28, as indicated by the arrow 30, to guide the yarn 23 to the nip between the winding roller 28 and the bobbin 27 for winding of the yarn in cross-wound fashion onto the bobbin 27. An auxiliary yarn guide 34 is similarly mounted on a reciprocable slide rod 65 adjacent the exit end of the yarn withdrawal tube 24 for traversing movement, as indicated by the directional arrow 31, with respect to the yarn take-up roller 26. A yarn monitoring device 35, such as a stop motion device, is mounted on a rotatable auxiliary shaft 36 intermediate the yarn take-up shaft 25 and the yarn guide 33. The yarn monitoring device 35 includes a yarn-sensing element 37 which is movably controlled by the auxiliary shaft 36 in a predetermined rhythm or other synchronism with respect to the withdrawn yarn 23 for purposes of monitoring the traveling movement and tensioning of the yarn 23. A controllable yarn storage device 38 is positioned intermediate the yarn monitoring device 35 and the yarn guide 33 for assisting in the winding of conical tapered yarn packages. The yarn storage device 38 basically includes a pair of stationary yarn eyelets 40,41 disposed at opposite sides of a yarn deflection roller 39 mounted on a reciprocable slide rod 66 for traversing movement with respect to the eyelets 40,41, as indicated by arrow 32.

An exhaust fan 68 is provided for applying suction to the rotor 3 for the purpose of producing a spinning vacuum within the rotor 3. For sake of clarity, the suction distribution lines from the exhaust fan 68 are not shown in the schematic drawing. A motor 95 is provided for driving the exhaust fan 68 by means of a drive belt 7 extending about a drive pulley 70 on the motor shaft 44 and a pulley 69 on the shaft 43 of the exhaust fan 68. A generator 96 is also driven by the motor 95 by a second drive belt 8 trained about a drive pulley 71 on the motor shaft 44 and a pulley 72 on the shaft 45 of the generator 96. The generator 96 is connected by a separation point 97 to a control voltage supply line 98 to provide a control voltage for the operation of the present invention, as hereinafter described. The motor 95 and the associated generator 96 are provided with interior rotor members (not shown) which, along with their respective belt pulleys, act as flywheels of a relatively significant mass which are sufficient at their normal operating speeds to sustain a minimum output by the generator 96 of the desired control voltage in the supply line 98 for a predetermined period of time, e.g. at least approximately two seconds, after operating power to the motor 95 is interrupted.

Another drive motor 104 is provided for driving the drive belt 6 for the opening roller 19, along with the opening rollers at each of the other spinning stations of the open end spinning machine 1. The motor 104 includes a step pulley 93 mounted on the motor shaft 46, which pulley 93 is drivingly connected by a drive belt 9 to another step pulley 94 mounted on a rotatable shaft 47. Another pulley 73 is mounted on the shaft 47, with the drive belt 6 trained about the pulley 73.

The open end spinning machine 1 further includes a main drive motor 106 arranged for driving the spinning rotors 3 and for driving through a power drive transmission 107 each of the sliver feed shaft 64, the yarn take-up shaft 25, the winding shaft 29, and the reciprocal yarn guide 33 and the yarn storage device 38. The main drive motor 106 includes an output drive shaft 48 extending from opposite sides of the motor 106 with drive pulleys 74 and 75 respectively fixed to opposite ends of the shaft 48. The drive belt 5 is trained about the pulley 74 for driving the shaft 4 of the spinning rotor 3, along with the corresponding rotor shafts at each other spinning station of the open end spinning machine. Another drive belt 10 is trained about the pulley 75 and another pulley 76 on a rotatable shaft 49 for driving a transmission drive train to the power drive transmission 107. A bevel gear 108 is fixed to the shaft 49 in meshing engagement with another bevel gear 109 fixed to a perpendicular rotatable shaft 50 which is coupled to another shaft 51 by a coupling device 61, such as a clutch or the like, having coupling components 118 and 119 respectively fixed to the shafts 50,51. A pulley 77 is fixed to the shaft 51 and is connected by a drive belt 11 in driving relationship with a pulley 78 fixed to one input shaft 52 to the power drive transmission 107.

A cogged disk 110 of a sensing device 114 is fixed to the shaft 50 to permit the sensing of the rotational speed of the shaft 50 as a proportional representation of the rotational speed of the spinning rotor 3. A controllable brake 122 is disposed in association with the shaft 51 for selective braking control thereof.

The power drive transmission 107 includes two output shafts 53 and 55. A drive pulley 81 is fixed to the output shaft 55 and is drivingly connected by a drive belt 12 to a pulley 82 fixed to the sliver feed shaft 64. Similarly, a drive pulley 79 is fixed to the other output shaft 53 and is drivingly connected by a drive belt 14 to a belt pulley 88 mounted on the yarn take-up shaft 25. Another belt pulley 89 is also fixed to the yarn take-up shaft 25 and is drivingly connected by a drive belt 18 with a belt pulley 92 fixed on the winding shaft 29. The power drive transmission 107 also includes a second input shaft 54 on which a pulley 80 is fixed. The pulley 80 is driven through a drive belt 13 by a drive pulley 87 fixed on a section 36' of the shaft 36. The shaft section 36' is driven by an auxiliary drive motor 129 by a drive belt 16 trained about a drive pulley 86 mounted on the drive shaft 57 of the auxiliary motor 129 and another pulley 85 mounted on the shaft section 36'. The auxiliary drive motor 129 is preferably a geared motor so that its output shaft 57 rotates at a reducible speed.

The power drive transmission 107 includes four selectively switchable coupling arrangements 133,134,135,136. The coupling device 133 is arranged for selectively connecting and disconnecting the input shaft 54 with the power drive transmission 107. The coupling device 134 enables the output shaft 55 to be selectively disengaged from the power drive transmission 107 or selectively coupled to either the input shaft 52 or the input shaft 54. The coupling device 136 is arranged for selectively connecting and disconnecting the output shaft 53 with the power drive transmission 107. The coupling device 135 is adapted for changing the rotational direction of the output shaft 53 and, in turn, for changing the yarn take-up shaft 25 from forward rotation to reverse rotation.

The winding shaft 29 is arranged for driving a yarn guide control device 123 and a yarn storage control device 124 which, in turn, respectively operate the yarn guide 33 and the yarn storage device 38. The yarn guide control device 123 includes a grooved control drum 125 fixed to a rotatable shaft 58. Similarly, the yarn storage control device 124 includes a grooved control drum 124 fixed to a rotatable shaft 59 which may be selectively coupled to and decoupled from the shaft 58 by a coupling device (not shown). A drive pulley 91 is fixed to the winding shaft 29 in driving relationship to a pulley 90 fixed to the shaft 58 by a drive belt 117 trained about the pulleys 90,91. A cam follower 127 is mounted on the slide rod 67 in following engagement in the groove of the yarn guide control drum 125 for producing reciprocal movement of the slide rod 67, upon rotational operation of the drum 125. In corresponding manner, a cam follower 128 mounted on the slide rod 66 is engaged in the groove of the yarn storage control drum 126 for producing reciprocal movement of the slide rod 66 upon rotational operation of the drum 126. The yarn storage control device 124 is normally out of operation during the winding of cylindrical cross-wound bobbins, as illustrated in the drawing, by decoupling the shaft 59 from the shaft 58. On the other hand, the shafts 58 and 59 are coupled for operation of the yarn storage control device 124 when winding conically tapered cross-wound bobbins having a considerable conicity.

In similar manner, the auxiliary drive motor 129 is arranged for driving reciprocal movement of the auxiliary yarn guide 34 from the auxiliary shaft section 36'. For this purpose, a drive pulley 84 is fixed to the shaft section 36' for driving another pulley 83 on a rotatable shaft 56 by a drive belt 15 trained about the pulleys 84,83. A grooved drum 131 of a control device 130 is also fixed to the shaft 56, with a cam follower lever 132 fixed to the slide rod 66 being engaged in the groove of the drum 131 for driving reciprocal movement of the slide rod 65 upon rotation of the drum 131. The resultant traversing motion of the auxiliary yarn guide 34 and the yarn 23 with respect to the yarn take-up shaft 25 and the take-up roller 26 causes these components to wear more evenly so as to prevent the undesirable formation of grooves in these components. The auxiliary shaft 36 and its auxiliary shaft section 36' are respectively provided with mated coupling members 120,121 of a selectively actuable coupling device 62, such as a clutch or the like, for enabling selective connection and disconnection of the shafts 36,36'. In addition, a cogged wheel 113 of a rotational speed sensing device 117 is fixed to the auxiliary shaft 36 for monitoring the rotational speed thereof. As desired, the auxiliary shaft 36 may also be arranged for driving a bobbin doffing device (not shown).

The sliver feed shaft 64 is also provided with a cogged wheel 111 of a rotational sensing device 115 to permit the measurement of the speed of the shaft 64 when under rotation, as well as any incremental degree of rotational movement thereof. Similarly, a cogged wheel 112 of a rotation sensor 116 is fixed to the yarn take-up shaft 25 for the same purpose.

Each of the motors 95,104,106 and 129 are provided with a respective electrical contactor 99,100,101, and 102 by which the motors are connected to a three-phase electrical power supply line 103 for providing operating power to the motors.

According to the present invention, the open end spinning machine 1 includes an electronic switching device 137 having operative electrical connections 138,139,140,141 respectively to the contactors 99,100,101,102 of the motors 95,104,106,129. Similarly, the rotation sensing devices 114,115,116,117 are electrically connected by connections 142,143,144,145, respectively, to the electronic switching device 137. In like manner, the coupling devices 60,61,62,133,134,135,136 are electrically connected by respective connections 146,147,148,149,150, 151,152 to the electronic switching device 137. In addition, the electronic switching device 137 is provided with an input control element 153 permitting the selection of the desired yarn withdrawal speed from the spinning rotor 3 and a similar input control element 154 permitting the selective setting of the peripheral contact pressure between the bobbin 27 and the winding drum 28. Preferably, the input elements 153,154 are rotary control knobs associated with a graduated indicator scale. The three-phase power supply line 103 is electrically connected to the switching device 137 by an electrical lead 155. Another electrical connection 156 operatively connects the braking device 152 to the electronic switching device 137.

For carrying out the present invention, the electronic switching device 137 is designed with a suitable electronic arrangement for performing the following functions during the operation of the present invention as more fully explained hereinafter: (a) to control a delay of the braking device 122 for braking the sliver feed shaft 64, the yarn take-up shaft 25 and the winding shaft 29 in accordance with adjustable programmed comparison values as a function of the rate of yarn withdrawal and the peripheral contact pressure between the winding drum 28 and the bobbin 27; (b) to calculate the length of the yarn 23 withdrawn from the rotor 3 during braking of the yarn take-up shaft 25 and the winding shaft 29 during any stoppage of the open end spinning machine 1 as a function of the degree of rotation of the yarn take-up shaft 25 measured by the rotation sensing device 116; (c) to store such calculated yarn length; (d) to calculate a yarn return feed length from the stored length with appropriate corrections, as necessary or desirable, according to programmed empirical values; (e) to control the coupling devices 134 and 135 for switching the yarn take-up shaft 25 for forward rotation, standstill or reverse rotation according to a predetermined program; (f) to switch the contactors 99,100,101,102 for actuating and deactuating the respective drive motors 95,104,106,129; (g) for actuating the coupling devices 60,133,135,136 for selectively disconnecting or driving the sliver feed roller 20, the yarn take-up shaft 25, the winding shaft 29 and the yarn guide control device 123 in relation to the rotor speed as measured by the rotation sensing device 114, according to a predetermined program; and (h) to control the coupling devices 61,133,134 for selectively coupling the sliver feed shaft 64, the yarn take-up shaft 25 and the winding shaft 29 to either the main drive motor 106 or the auxiliary drive motor 129. As those persons skilled in the art will recognize, any electronic switching device having a suitable arrangement of electronic components adapted for performing the foregoing functions will suffice for purposes of the present invention but it is preferred that a conventional programmable microprocessor be utilized to most advantageously satisfy the requirements of the present invention. To insure the continuous operation of the electronic switching device 137 throughout the course of operation of the open end spinning machine 1, the device 137 is independently connected to a separate supply voltage source 157.

The operation of the present invention will thus be understood. In the ordinary course of operation of the open end spinning machine 1, each of the contactors 99,100,101,102 is closed to supply electrical power to their respective motors from the three-phase electrical power supply line 103. Upon the occurrence of any interruption, intentional or unintentional, in the power supply 103, the switching device 137 initially detects the power interruption through lead 155 and automatically actuates a timing device within the switching device 137. The timing device is set to measure a predetermined time period, preferably for example approximately two seconds, with the electronic switching device 137 being arranged to maintain the contactors 99,100,101,102 in their closed operative positions for the duration of such time period, during which the generator 96 is effective to maintain a minimum control voltage in the control voltage line 98 for continued operation of the open end spinning machine 1. In the event operating voltage is restored in the power supply line 103 during the timed period, the open end spinning machine 1 will continue in normal operation unaffected by the momentary power interruption. The timing device of the electronic switching device 137 automatically resets in preparation for any subsequent power interruption.

On the other hand, in the event the interruption in the power supply through the three-phase line 103 continues beyond the timed period, the electronic switching device 137 automatically initiates the following sequence for accomplishing stoppage of the open end spinning machine 1. Initially, the contactors 99,100,101 to the motors 95,104 and 106 are immediately opened upon the expiration of the timed period, but as will be understood, a run-down period will elapse while the motors slow to a standstill. Similarly, the contactor 102 to the auxiliary drive motor 129 is also opened, but is controlled by the electronic switching device 137 to occur when the yarn sensing element 37 of the yarn monitoring device 35 is out of contact with the yarn 23, this being determined by the electronic switching device 137 through its scanning of the rotational disposition of the shaft 36 as reflected by the rotation sensing device 117. The electronic switching device 137 also disengages the coupling device 62 to decouple the shaft 36 from the shaft section 36' at the same time as the deactuation of the auxiliary drive motor 129. After a delay determined as a function of the yarn take-up speed set at the input control element 153, the coupling device 61 is disengaged to decouple the drive connection between the main drive motor 106 and the power drive transmission 107, whereupon the electronic switching device 137 actuates the brake 122 in a controlled manner to brake the power drive transmission 107 along with the drive components driven thereby. The coupling device 60 is also disengaged to decouple the sliver feed rollers 20 from the sliver feed shaft 64 to stop further feeding of the sliver into the rotor 3. At the same time, each coupling device 60 at each other spinning station is also disengaged. From the time of disengagement of the coupling devices 60, the electronic switching device 137 calculates the length of the yarn 23 thereafter withdrawn from the spinning rotor 3 as reflected by the degree of subsequent rotation of the yarn take-up shaft 25 until it reaches a standstill, as reflected by the rotational sensing device 116. This calculated yarn length value provides a measure for the control of the subsequent restarting of the open end spinning machine 1 by the electronic switching device 137, as hereinafter more fully explained. That is, the greater the run-down time required by the yarn take-up shaft 25 to reach a standstill, the further the trailing end of the yarn 23 will be removed from the spinning rotor 3 and, in turn, the greater the yarn length and time required in returning the yarn end to the rotor 3 in restarting the machine 1. The electronic switching device 137 thus stores the measured yarn length value as reflected by the run-down rotation of the yarn take-up shaft 25 for the subsequent restarting procedure.

During the braking of the power drive transmission by the brake 122, the electronic switching device 137 controls the braking time required to reach a standstill of the yarn withdrawal components by calculating the continuing rotation of the yarn take-up shaft 25 as measured by the rotation sensing device 116 per unit of braking time and comparing the calculated value with programmed comparison values which are functions of the yarn take-up speed set at the input control element 153 and of the contact pressure between the bobbin 27 and the winding drum 28 set at the input control element 154. In turn, the electronic switching device 137 controls the tension loading of the brake 122 on the shaft 51 in accordance with such comparison to insure that the required braking time does not become too great, in which case the bobbin 27 may tend to slide with respect to the drum 28 and expose the yarn 23 to excessive strain.

As will be understood, the braking of the shaft 51 by the brake 122 effectively brakes each of the sliver feed shaft 64, the yarn take-up shaft 25, the winding shaft 29, the yarn storage device 38 and the yarn guide 33 to bring these elements to a standstill simultaneously. At the same time, the spinning rotors 3 and opening rollers 19 at each spinning station, together with the drive components driven from the auxiliary drive motor 129, gradually slow to a standstill independently of the other machine components. Once all such components have reached a standstill, the stoppage of the open end spinning machine 1 is completed.

Once the open end spinning machine 1 is ready for restarting, the power supply through the three-phase power supply line 103 is initially energized through a control switch or another conventional manner, whereupon the machine restarting procedure is controlled automatically by the electronic switching device 137. Thereupon, the electronic switching device 137 immediately closes contactor 99 to actuate the drive motor 95 to drive the exhaust fan 68 and the generator 96, which establishes the required control voltage in the control voltage supply line 98 for the subsequent restart switching and regulating procedures.

Once the generator 96 is actuated to establish the necessary control voltage, the contactor 100 to the drive motor 104 is closed to actuate driven operation of the opening rollers 19 at each spinning station. Following the actuation of the opening rollers 19, the contactors 101,102 to the main drive motor 106 and the auxiliary drive motor 129 are automatically closed to initiate driving operation of the spinning rotors 3 at each spinning station and the driven components from the drive motor 129. However, as will be recognized, the power drive transmission 107 remains decoupled from the main drive motor 106 as a result of the previous disengagement of the coupling device 61 and, similarly, the shaft 36 remains decoupled from the driven shaft section 36' as a result of the previous disengagement of the coupling device 62. The coupling devices 133,134 of the power drive transmission 107 are also automatically actuated to couple the sliver feed shaft 64 in driven relationship to the auxiliary drive motor 129.

Following actuation of the main drive motor 106, the electronic switching device 137 monitors the rotational speed of the spinning rotor 3 as reflected by the rotational speed of the shaft 50, also driven by the motor 106, as measured by the rotation sensing device 114. The electronic sensing device 137 is set with a first rotor speed determined by the setting of control element n1 and with a second rotor speed determined by the setting of control element n2. The second rotor speed n2 is determined as a function of the diameter of the spinning rotors 3 and the desired rotor operating speed, while the first rotor speed n1 is established as a function of the second rotor speed n2.

When the rotors 3 have attained the first predetermined rotor speed n1, the electronic switching device 137 engages the coupling device 60 at each spinning station to automatically place the sliver feed rollers 20 in driven relationship with the sliver feed shaft 64 and, in turn, with the auxiliary drive motor 129. Thereupon, the sliver feed rollers 20 and opening rollers 19 at each spinning station begin feeding the sliver 21 to each spinning rotor 3. The electronic switching device 137 calculates the length of sliver so fed to the spinning rotors as a function of the degree of rotation of the sliver feed shaft 64 as reflected by the rotation sensing device 115 associated therewith. An adjustable control element 158 is provided on the electronic switching device 137 for setting a predetermined start-up length of sliver and, once the calculated length of sliver fed into the spinning rotors 3 attains the value set by the control element 158, the electronic switching device 137 actuates disengagement of the coupling devices 60 to deactuate the sliver feed rollers 20. Thereupon, an advance start-up amount of opened fibers 22 has been fed into the spinning rotors 3.

As will be understood, the spinning rotors 3 continue to accelerate in rotational speed as the restarting procedure progresses. Once the spinning rotors 3 attain the second predetermined rotor speed n2, the coupling devices 135,136 are automatically actuated by the electronic switching device 137 to drive the yarn take-up shaft 25 and the winding shaft 29 from the auxiliary drive motor 129 in reverse rotational direction from their normal forward direction of rotational yarn withdrawing and winding movement. As a result, the trailing end length of the yarn 23 previously withdrawn from the spinning rotor 3 during the machine stoppage procedure above described is thereby fed back into the rotor 3. The switching device 137 calculates the length of fed-back yarn as a function of the degree of reverse rotation of the yarn take-up shaft 25 as reflected by the rotation sensing device 116 and compares the calculated value with the previously calculated and stored value of the length of yarn withdrawn from the rotor 3 during the stoppage procedure. When the return length of the yarn 23 corresponds to the stored yarn length value, the switching device 137 disengages the coupling device 136 to stop further reverse rotation of the yarn take-up shaft 25 and the winding shaft 29 and switches the coupling device 135 from reverse to forward setting to enable forward rotation of the yarn take-up shaft 25 and the winding shaft 29. Simultaneously, the switching device 137 deactuates the coupling device 133 and engages the coupling device 61 to decouple the power drive transmission 107 from driven relationship with the auxiliary drive motor 129 and reestablish normal operative driving relationship between the main drive motor 106 and the power drive transmission 107. The coupling device 134 is also actuated to bring the sliver feed shaft 64 into normal driven relationship with the main drive motor 106. Following the passage of a predetermined dwell time of approximately a few seconds, the coupling device 136 is reactuated to return the yarn take-up shaft 25 and the winding shaft 29 to normal forward driven relationship with the main drive motor 106. As will be understood, the forward driven operation of the winding shaft 29 also produces driven rotation of the shaft 58 and the yarn guide control device 123 mounted thereon for reciprocal traversing operation of the slide rod 67, as indicated by arrow 30. For the winding of a cylindrical cross-wound bobbin 27 as illustrated, the shaft 59 is decoupled form the shaft 58 so that the yarn storage control device 124 and its associated slide rod 66 are out of operation. The coupling device 60 is also reactuated to return the sliver feed rollers 20 to driven relationship with the sliver feed shaft 64. The auxiliary drive motor 129 remains in operation for driving reciprocal traversing movement of the slide rod 65 in the direction of arrow 31. Thus, normal spinning and winding operation of the open end spinning machine 1 is resumed.

After a predetermined delay of approximately two seconds, the electronic switching device 137 reengages the coupling device 62 to recouple the auxiliary shaft 36 with the shaft section 36' for rotational driving of the shaft 36 from the auxiliary drive motor 129. Thereupon, the yarn monitoring operation of the yarn monitoring device 35 is resumed as well.

In the above-described machine stoppage and restarting procedures, the sliver feed rollers 20 may alternatively be actuated and deactuated by the actuation and deactuation of the transmission coupling device 134 rather than the actuation and deactuation of the coupling devices 60 as described. Further, as necessary, the electronic switching device 137 could be electrically connected to the control voltage power supply line 98 rather than to the independent voltage source 157. During any stoppage of the open end spinning machine 1, an increased peripheral contact pressure of the bobbin 27 on the winding roller 28 may be accomplished by, for example, loading the bobbin creel (not shown) by means of an additional increased spring force or in another suitable manner, in order to reduce the risk of slippage of the bobbin 27. Also, the spinning rotors 3 may be subjected to a cleaning process as desired during any stoppage of the spinning machine 1 by, for example, temporarily opening closures (not shown) in cleaning conduits or tubes (also not shown) which may be connected between the spinning rotor 3 and the distribution lines of the exhaust fan 68, whereby any accumulation of dirt and fibers may be removed from the spinning rotors 3.

The open end spinning machine 1 also facilitates the change of the twist in the yarn 23 by the replacement of the pulleys 77,78 with other substitute pulleys. Similarly, the draft of the spinning machine 1 may be changed by the replacement of the pulleys 81,82. Changing the disposition of the drive belt 9 on the stepped pulleys 93,94 permits the rotational speed of the opening rollers 19 to be changed.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for stopping and subsequently restarting an open end spinning machine of the type having a spinning rotor, means for rotating said spinning rotor, means for feeding sliver to said spinning rotor, means for opening said sliver intermediate said sliver feeding means and said rotor, means for withdrawing and winding yarn from said spinning rotor, and a power supply, said method comprising the steps of:

(a) upon an interruption in said power supply, deactuating said rotor rotating means, said sliver feeding means, said sliver opening means and said yarn withdrawing and winding means; after a delay following said deactuating, said delay being determined in relation to the rate of yarn withdrawal from said rotor, braking said yarn withdrawing and winding means to a standstill; and determining and storing a value representing the length of yarn withdrawn by said yarn withdrawing and winding means during said braking; and (b) restarting said rotor rotating means, sliver feeding means, sliver opening means and yarn withdrawing and winding means by the steps of first actuating said sliver opening means and then actuating said rotor rotating means and monitoring an operating parameter of said rotor rotating means representative of the speed of said rotor; when said rotor attains a predetermined first speed, actuating said sliver feeding means to feed a predetermined start-up length of sliver to said rotor and then deactuating said sliver feeding means; when said rotor attains a predetermined second speed, actuating said yarn withdrawing and winding means in reverse direction to feed back to said rotor a length of withdrawn yarn corresponding to said stored value; and then actuating said yarn withdrawing and winding means in forward direction and again actuating said sliver feeding means.

2. A method for stopping and subsequently restarting an open end spinning machine according to claim 1 and characterized further in that said second speed is determined as a function of the desired operating speed of said rotor and said first speed is determined as a function of said second speed.

3. A method for stopping and subsequently restarting an open end spinning machine according to claim 1 and characterized further in that, upon said interruption, said deactuating said rotor rotating means, said sliver feeding means and said yarn withdrawing and winding means occurs only following duration of said interruption exceeding a predetermined time period.

4. A method for stopping and subsequently restarting an open end spinning machine according to claim 3 and characterized further by generating a control voltage sustainable for said predetermined time period following said interruption to prevent said deactuating during the duration of said predetermined time period.

5. A method for stopping and subsequently restarting an open end spinning machine according to claim 4 and characterized further in that, upon said restarting, said generating is reactuated in advance of said actuating said rotor rotating means.

6. A method for stopping and subsequently restarting an open end spinning machine according to claim 4 and characterized further in that said predetermined time period is approximately two seconds.

7. A method for stopping and subsequently restarting an open end spinning machine according to claim 1 and characterized further in that said open end spinning machine includes suction means for producing a spinning vacuum within said rotor, said restarting step further comprising actuating said suction means in advance of said actuating said rotor rotating means.

8. A method for stopping and subsequently restarting an open end spinning machine according to claim 1 and characterized further in that said yarn withdrawing and winding means includes a yarn take-up shaft for withdrawing yarn from said rotor, a yarn package for peripheral winding of yarn thereabout and a winding drum rotatable in peripheral driving contact with said package during yarn winding, said braking comprising braking said yarn take-up shaft and said winding drum in a controlled manner in relation to the rate of yarn withdrawal from said rotor and the peripheral contact pressure between said winding drum and said yarn package.

9. A method for stopping and subsequently restarting an open end spinning machine according to claim 8 and characterized further in that, during each deactuating, increasing the peripheral contact pressure between said winding drum and said yarn package over the pressure value prevailing during operation of said yarn withdrawing and winding means.

10. A method for stopping and subsequently restarting an open end spinning machine according to claim 1 and characterized further in that said open end spinning machine comprises first traversable yarn guide means, auxiliary traversable yarn guide means, and yarn tension monitoring means, said deactuating step including deactuating said first yarn guide means, said auxiliary yarn guide means and said yarn tension monitoring means and said braking step includes braking said first yarn guide means simultaneously with said yarn withdrawing and winding means.

11. A method for stopping and subsequently restarting an open end spinning machine according to claim 10 and characterized further in that said open end spinning machine comprises selectively traversable yarn storage means, said deactuating step including deactuating said yarn storage means and said braking step including braking said yarn storage means simultaneously with said braking said yarn withdrawing and winding means.

12. A method for stopping and subsequently restarting an open end spinning machine according to claim 10 and characterized further in that said yarn tension monitoring means is arranged for movement into and out of contact with said yarn, said method further comprising controlling said disengaging said yarn tension monitoring means to occur only when out of contact with said yarn.

13. In an open end spinning machine of the type having a spinning rotor, means for rotating said spinning rotor, means for feeding sliver to said spinning rotor, means for opening said sliver intermediate said sliver feeding means and said rotor, means for withdrawing and winding yarn from said spinning rotor, and a power supply, apparatus for stopping and subsequently restarting said open end spinning machine comprising means for controlling the deactuation and reactuation of said rotor rotating means, said sliver feeding means, said sliver opening means and said yarn withdrawing and winding means upon an interruption in said power supply, said controlling means including means for initially deactuating said rotor rotating means, said sliver feeding means, said sliver opening means and said yarn withdrawing and winding means upon said interruption, means for braking said yarn withdrawing and winding means to a standstill, said controlling means being operative to delay said braking means following deactuation of said rotor rotating means, said sliver feeding means, said sliver opening means and said yarn withdrawing and winding means for a period of time determined in relation to the rate of yarn withdrawal from said rotor, means for determining and storing a value representing the length of yarn withdrawn by said yarn withdrawing and winding means during said braking, and means operative upon restarting of said open end spinning machine for initially actuating said sliver opening means and then actuating said rotor rotating means, for monitoring an operating parameter of said rotor rotating means representative of the speed of said rotor following actuation of said rotor rotating means, for actuating said sliver feeding means to feed a predetermined start-up length of sliver to said rotor when said rotor attains a first predetermined speed and then deactuating said sliver feeding means, for actuating said yarn withdrawing and winding means in reverse direction when said rotor attains a second predetermined speed to feed back to said rotor a length of withdrawn yarn corresponding to said stored value, for then actuating said yarn withdrawing and winding means in forward direction and for again actuating said sliver feeding means.

14. Apparatus for stopping and subsequently restarting an open end spinning machine according to claim 13 and characterized further in that said controlling means includes timer means for deactuating said rotor rotating means, said sliver feeding means and said yarn withdrawing and winding means only following duration of said interruption exceeding a predetermined time period.

15. Apparatus for stopping and subsequently restarting an open end spinning machine according to claim 14 and characterized further in that said controlling means comprises a generator operatively connected to said power supply for generating a control voltage for said controlling means, said generator including flywheel means of sufficient mass and normal operating velocity to sustain said control voltage for said predetermined time period following said interruption to prevent deactuation of said rotor rotating means, said sliver feeding means and said yarn withdrawing and winding means during the duration of said predetermined time period.

16. Apparatus for stopping and subsequently restarting an open end spinning machine according to claim 15 and characterized further in that said restarting means is operative to reactuate said generator in advance of said rotor rotating means.

17. Apparatus for stopping and subsequently restarting an open end spinning machine according to claim 13 and characterized further in that said open end spinning machine includes suction means for producing a spinning vacuum within said rotor, said restarting means being operative for actuating said suction means in advance of said rotor rotating means.

18. Apparatus for stopping and subsequently restarting an open end spinning machine according to claim 13 and characterized further in that said yarn withdrawing and winding means includes a yarn take-up shaft for withdrawing yarn from said rotor, a yarn package for peripheral winding of yarn thereabout and a winding drum rotatable in peripheral driving contact with said package during yarn winding, said controlling means being adapted to regulate said braking means for braking said yarn take-up shaft and said winding drum in a controlled manner in relation to the rate of yarn withdrawal from said rotor and the peripheral contact pressure between said winding drum and said yarn package.

19. Apparatus for stopping and subsequently restarting an open end spinning machine according to claim 13 and characterized further in that said open end spinning machine comprises first traversable yarn guide means, auxiliary traversable yarn guide means and yarn tension monitoring means, said controlling means being operative for deactuating each thereof upon said interruption and said braking means being operative for braking said first yarn guide means simultaneously with said yarn withdrawing and winding means.

20. Apparatus for stopping and subsequently restarting an open end spinning machine according to claim 19 and characterized further in that said open end spinning machine includes selectively traversable yarn storage means, said controlling means being operative for deactuating said yarn storage means upon said interruption and said braking means being operative for braking said yarn storage means simultaneously with said yarn withdrawing and winding means.

21. Apparatus for stopping and subsequently restarting an open end spinning machine according to claim 19 and characterized further in that said yarn tension monitoring means is arranged for movement into and out of contact with said yarn, said controlling means being operative for deactuating said yarn monitoring means only when out of contact with said yarn.

22. Apparatus for stopping and subsequently restarting an open end spinning machine according to claim 13 and characterized further in that said open end spinning machine includes a main drive motor and first associated drive train means for driving said rotor rotating means, said sliver feeding means and said yarn withdrawing and winding means during normal operation of said machine, an auxiliary drive motor and second associated drive train means for driving said sliver feeding means and for reverse driving of said yarn withdrawing and winding means during restarting of said machine following said interruption, and transmission means associated with said first and second drive train means for selectively coupling said sliver feeding means and said yarn withdrawing and winding means with one of said main and auxiliary drive motors, said controlling means being operatively associated with said transmission means for controlling coupling thereof with said sliver feeding means and said yarn withdrawing and winding means.

* * * * *